US005167791A

United States Patent [19]

Herbert et al.

[11] Patent Number: 5,167,791

[45] Date of Patent: Dec. 1, 1992

[54] PROCESS FOR ELECTROLYTIC DEPOSITION OF IRON

[75] Inventors: William G. Herbert, Williamson; Abraham Cherian, Webster; Peter J. Schmitt, Ontario, all of N.Y.

[73] Assignee: Xerox Corporation, Stamford, Conn.

[21] Appl. No.: 811,352

[22] Filed: Dec. 20, 1991

[51] Int. Cl.[5] ..... C25D 1/00; C25D 3/20

[52] U.S. Cl. ..... 205/67; 205/270

[58] Field of Search ..... 205/67, 270

[56] References Cited

U.S. PATENT DOCUMENTS 4,231,847 11/1980 Lui ..... 204/7
4,354,915 10/1982 Stachurski et al. ..... 204/242
4,400,408 8/1983 Asano et al. ..... 427/35
4,414,064 11/1983 Stachurski et al. ..... 204/37 R
4,421,626 12/1983 Stachurski et al. ..... 204/290 R
4,422,920 12/1983 Stachurski et al. ..... 204/290 R
4,664,758 5/1987 Grey ..... 204/3

*Primary Examiner*—T. M. Tufariello
*Attorney, Agent, or Firm*—Oliff & Berridge

[57] ABSTRACT

Electroformed and/or electroplated iron with superior ferro-magnetic properties is prepared by an electrolytic process wherein the iron is deposited from an electrolyte bath containing iron salts and preferably substantially free of carbon. The bath and its environment are substantially free of oxygen and other oxidizing agents. A titanium-palladium alloy is a preferred electrode upon which to deposit the iron.

24 Claims, 1 Drawing Sheet

PROCESS FOR ELECTROLYTIC DEPOSITION OF IRON

This invention relates to a novel process for electroplating and/or electroforming Iron.

BACKGROUND OF INVENTION

Electroplated and/or electroformed iron is known to have superior ferromagnetic properties. For example, a 0.0001 inch thick by 1.0 square inch deposit on a 0.5 inch non-ferro-magnetic stainless steel shaft which is 12 inches long enables the shaft to be picked up with a magnet. This superior ferro-magnetic property is possible with iron prepared by an electrolytic process because this method is capable of producing iron of very high purity. Yet, while methods of electrodepositing iron are known, an efficient method for continuously electrodepositing iron on a commerical scale is not known, primarily because of the instability of the electrolyte solution used in the process. Much effort has been devoted without success to a search for stable electrolytes for the process. There is a need for a method of electrodepositing iron wherein a stable electrolyte solution can be maintained throughout the process.

U.S. Pat. No. 4,231,847 to Lui discloses a method for electrodepositing nickel-iron alloys. In this method, an electrolyte solution containing nickel chloride and ferrous sulfate is used to deposit nickel and iron onto a substrate in specified proportions. The pH of the Lui electrolyte solution is stated to be critical, being maintained at less than 3 and preferably from 1 to 3. Free oxygen is excluded from the electrolyte solution, and the solution is agitated during deposition, by bubbling inert gas through the electrolyte solution while current is passed through the electrolyte solution thereby depositing the iron-nickel alloy onto the substrate. Such a process has significant drawbacks. Bubbling the inert gas through the electrolyte solution during electrodeposition requires plating at lower current densities such as 30–50 amps per square foot. Deposition speed is thus quite low. The bubbling also would result in substantial evaporation of electrolyte solution components such as water and hydrogen chloride (used by Lui as a pH adjuster). This results in difficult-to-predict electrolyte solution compositions and concentrations and pH variations during the process, as well as requiring substantial efforts to dispose of or recycle the resulting waste gas and vapor. The bubbling would also cause marks on the outer surface of the electrodeposited material and would cause difficulties with foaming and temperature control.

U.S. Pat. No. 4,414,064 to Stachurski et al. discloses a method for preparing low voltage hydrogen cathodes wherein the cathode comprises an active surface portion from a codeposit of three metals, including iron. Certain conductive metals or alloys, including a titanium-palladium alloy containing 0.2% palladium, are disclosed to be suitable materials for the substrate, having the required electrical and mechanical properties for use as a cathode, and chemical resistance to the particular electrolytic solution. In chlorate cells, where corrosion of the substrate material may be a problem, titanium or titanium alloys are said to be preferred.

U.S. Pat. No. 4,664,758 to Grey discloses an electroforming process comprising: 1) providing an elongated electroforming mandrel core; 2) applying a substantially uniform coating of a molten, inert, inorganic, homogeneous, electrically conductive metal or metal alloy to the mandrel core, the metal or metal alloy having a melting point and surface tension less than that of the mandrel core; 3) immersing the mandrel core bearing the coating in an electroforming bath; and 4) removing the electroformed metal from the mandrel core. Suitable metals capable of being deposited by electroforming are said to include iron; suitable mandrel cores are said to include titanium-palladium alloys.

U.S. Pat. No. 4,400,408 to Asano et al. discloses a method for forming an anticorrosive coating on the surface of a metal substrate. Suitable metal substrates are said to include titanium alloys and iron. Metals suitable for coating on the surface of the substrate are said to be those which have excellent corrosion resistance and which can be alloyed with the substrate metal.

SUMMARY OF THE INVENTION

It is an object of the invention to provide a method of electrodepositing iron with superior ferro-magnetic properties.

This and other objects are achieved by a process for electrolytically depositing iron wherein an electrolyte bath comprising iron salts, preferably substantially free of carbon, and its atmosphere are substantially free of oxygen and other oxidizing agents. The process takes place in an apparatus which maintains such an environment by such methods as enveloping the electrolyte in an inert gas, purging any oxygen from the apparatus by employing chambers with air locks to prevent any passage of oxygen into the chambers, and by aerating water and other constituent materials used in the electrolyte chamber with nitrogen prior to their use in the chamber. Oxidizing agents are excluded from the electrolyte solution, which is preferably also substantially free of carbon.

DETAILED DESCRIPTION OF PREFERRED EMBODIMENTS

Figure 1:
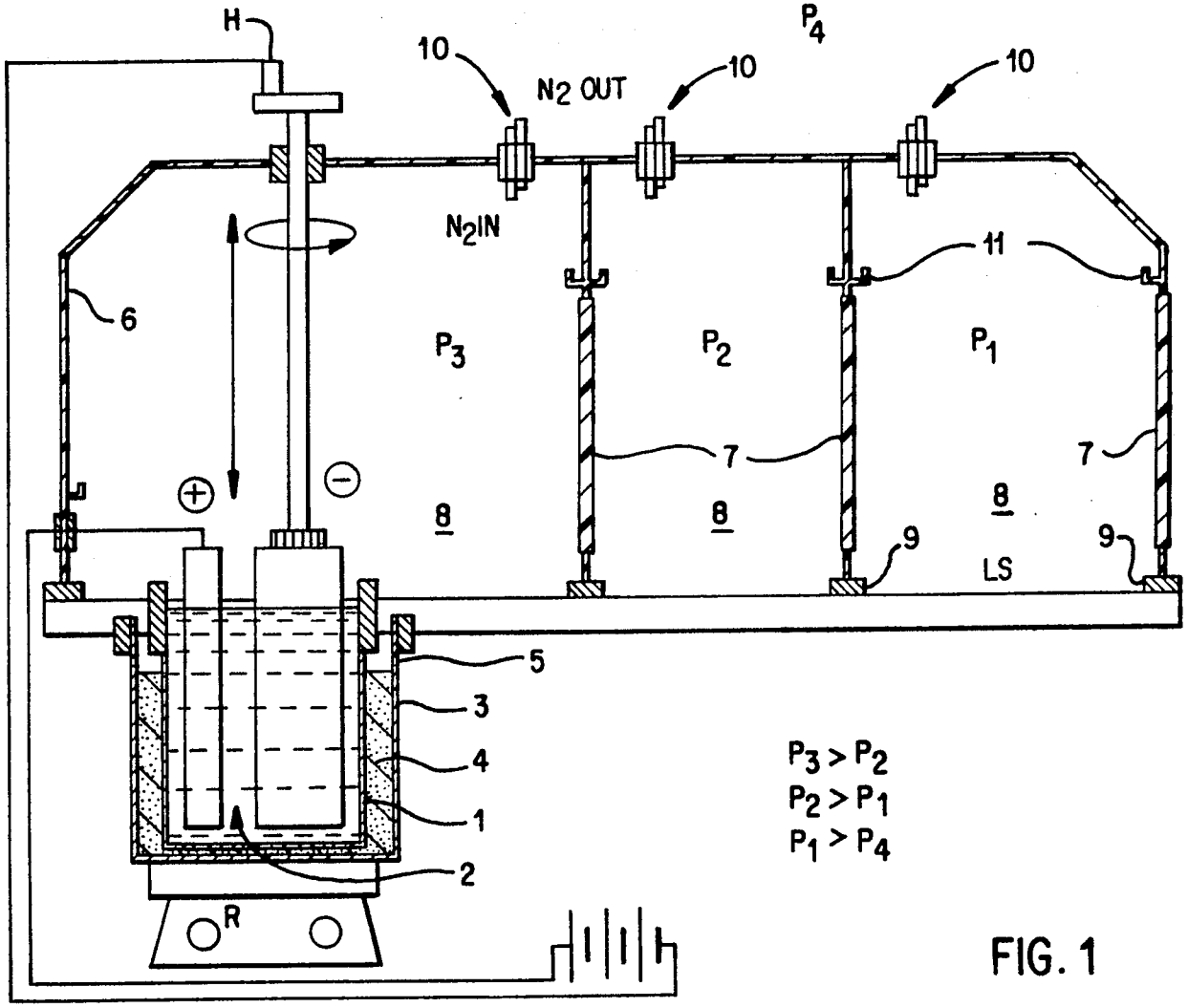
FIG. 1 is an electroforming apparatus for practicing the process of the invention.

According to the present invention, highly pure iron is electrodeposited; e.g., electroplated onto a substrate or electroformed to form a thin, iron electroform. An electrolytic process is employed to produce the electrodeposited iron, wherein an electrolyte bath comprising iron salts is formed, electrodes are immersed in the electrolyte bath and iron from the electrolyte bath is electrodeposited on at least one of the electrodes. The electrodeposition takes place in an environment substantially free of oxygen and other oxidizing agents that oxidize $Fe^{+2}$ to $Fe^{+3}$ such as permanganate, nitrate, nitrite and sulfite. The process takes place in an apparatus which maintains such an environment by such methods as enveloping the electrolyte in an inert gas, purging any oxygen from the apparatus by employing chambers with air locks to prevent any passage of oxygen into the chambers, and by aerating water and other constituent materials used in the electrolyte chamber with nitrogen prior to their use in the chamber. Oxidizing agents are excluded from the electrolyte solution, which is preferably also substantially free of carbon.

In the electrolytic process of this invention, the electrolyte contains iron salts. Salts of iron which may be used in this process include iron halides such as ferrous chloride ($FeCl_2.4H_2O$), ferrous ammonium sulfate ($FeSO_4(NH_4)_2SO_4.6H_2O$), ferrous sulfate ($FeSO_4.7H_2O$) and ferrous fluoroborate ($Fe(BF_4)_2$). Preferably, ferrous chloride ($FeCl_2.4H_2O$), ferrous ammonium sulfate ($FeSO_4(NH_4)_2SO_4.6H_2O$) or ferrous sulfate ($FeSO_4.7H_2O$) of reagent grade purity are used.

Segregation of the iron from carbon and other impurities is enabled by the fact that carbon is not soluble in the electrolyte used in the electrolytic process; even if it were, it would not plate out because it generally does not participate in the electrolytic reaction of the invention. The carbon will not be included in the deposit if there is careful control of the solution purity, pH, temperature, and anode sludge containment.

A preferred method for electrodepositing iron according to this invention is by an electrolytic process similar to those disclosed in *Electroplating*; Lowenheim, Frederick Adolph; McGraw-Hill, New York (1978). An electrolyte bath is formulated for electrolytically depositing iron from the bath onto at least one electrically conductive mandrel. For electroforming, the mandrel should have an abhesive outer surface. For electroplating, the deposited iron should bind firmly to the mandrel or a substrate on the mandrel. The process described below provides that the iron is deposited on the cathode.

The electrolytic process takes place within an electrolytic zone comprised of an anode, a cathode which is the mandrel, and an electrolyte bath comprising a salt solution of iron, in which bath both the anode and the cathode are immersed.

The atmosphere of the electrolytic zone should be substantially devoid of oxygen. When using a halo (e.g., chloro) salt of iron, the atmosphere is preferably saturated with the corresponding hydrogen halide (e.g., HCl). Under these conditions, $Fe^{+2}$ is not oxidized to the $Fe^{+3}$ state. Furthermore, the concentration of hydrogen halide is stabilized in the electrolyte bath.

Preferred electrolyte systems are listed in Tables 1-3.

TABLE 1

| | |
|---|---|
| MAJOR ELECTROLYTE CONSTITUENTS: | |
| Ferrous sulfate - as $FeSO_4.7H_2O$, | 25-35 oz/gal. (187.5-262.5 g/L) |
| Chloride - as $FeCl_2.4H_2O$, | 3-6 oz/gal. (22.5-45 g/L) |
| Calcium chloride - as $CaCl_2.2H_2O$, | 1-50 oz/gal. (7.5-3 g/L) |
| pH - | 1.85-5.5 at 25° C. (Adjusted With $H_2SO_4$) |
| Surface Tension - | at 60° C., 50-60 d/cm using sodium lauryl sulfate (about 0.00005 g/L) |
| IMPURITIES: | |
| Aluminum - | 0-10 mg/L. |
| Ammonia - | 0-4 mg/L. |
| Arsenic - | 0-800 mg/L. |
| Barium - | 0-4 mg/L. |
| Copper - | 0-2 mg/L. |
| Carbon - | 0-2 mg/L. |
| Hexavalent chromium - | 4 mg/L maximum. |
| Iron $Fe^{+3}$ - | 0-50 mg/L. |
| Lead - | 0-5 mg/L. |
| Nitrate - | 0-10 mg/L. |
| Organics - | (Depends on the type, however, all known types are preferably minimized.) |
| Phosphates - | 0-10 mg/L. |
| Silicates - | 0-10 mg/L. |
| Sodium - | 0-1 gm/L. |
| Strontium - | 0-50 mg/L. |
| Zinc - | 0-5 mg/L. |
| OPERATING PARAMETERS: | |
| Agitation Rate - | 4-6 Linear ft/sec solution flow over the cathode surface. |
| Cathode (Mandrel) - | Current Density, 10-400 ASF (amps per square foot). |
| Ramp Rise - | 0 to operating amps in 0 to 5 min. ± 2 sec. |
| Plating Temperature at Equilibrium - | 90-115° C. |
| Anode - | High purity Armco ® iron or the like. |
| Anode to Cathode Ratio - | 1:1 minimum |
| Cathode Atmosphere - | $N_2$ Saturated with $H_2O$ |

TABLE 2

| | |
|---|---|
| MAJOR ELECTROLYTE CONSTITUENTS: | |
| Ferrous chloride - as $FeCl_2.4H_2O$, | 30-60 oz/gal. (225-450 g/L) |
| Calcium chloride - as $CaCl_2.2H_2O$, | 15-30 oz/gal. (112.5-225 g/L) |
| pH - | 1.0-2.0 at 25° C. (Adjusted With HCl) |
| Surface Tension - | at 60° C., 50-70 d/cm using sodium lauryl sulfate (about 0.00005 g/L) |
| IMPURITIES: | |
| Aluminum - | 0-10 mg/L. |
| Ammonia - | 0-4 mg/L. |
| Arsenic - | 0-800 mg/L. |
| Barium - | 0-4 mg/L. |
| Copper - | 0-2 mg/L. |
| Carbon - | 0-2 mg/L. |
| Hexavalent chromium - | 4 mg/L maximum. |
| Iron ($Fe^{+3}$) - | 0-50 mg/L. |
| Lead - | 0-5 mg/L. |
| Nitrate - | 0-10 mg/L. |
| Organics - | (Depends on the type, however, all known types are preferably minimized.) |
| Phosphates - | 0-10 mg/L. |
| Silicates - | 0-10 mg/L. |
| Sodium - | 0-1 gm/L. |
| Strontium - | 0-50 mg/L. |
| Zinc - | 0-5 mg/L. |
| OPERATING PARAMETERS: | |
| Agitation Rate - | 4-6 Linear ft/sec solution flow over the cathode surface. |
| Cathode (Mandrel) - | Current Density, 10-150 ASF (amps per square foot). |
| Ramp Rise - | 0 to operating amps in 0 to 5 min. ± 2 sec. |
| Plating Temperature at Equilibrium - | 85-101° C. |
| Anode - | High purity Armco ® iron or the like. |
| Anode to Cathode Ratio - | 1:1 minimum. |
| Cathode - | titanium-palladium, 304 stainless steel |
| Atmosphere - | $N_2$ Saturated with $H_2O$ and/or HCl |

TABLE 3

| | |
|---|---|
| MAJOR ELECTROLYTE CONSTITUENTS: | |
| Ferrous sulfate - as $FeSO_4.7H_2O$, | 15-32 oz/gal. (225-240 g/L) |
| pH | 2.5-3.4 at 25° C. (Adjusted with $H_2SO_4$) |
| Surface Tension - at 60° C., | 35-70 d/cm using Sodium Lauryl Sulfate (about 0.00005 g/L) |
| IMPURITIES: | |
| Aluminum | 0-10 mg/L. |
| Ammonia | 0-4 mg/L. |
| Arsenic | 0-800 mg/L. |
| Barium | 0-4 mg/L. |
| Copper | 0-2 mg/L. |
| Carbon | 0-10 mg/L. |
| Hexavalent chromium | 4 mg/L maximum. |
| Iron ($Fe^{+3}$) | 0-50 mg/L. |
| Lead | 0-5 mg/L. |

TABLE 3-continued

| | |
|---|---|
| Nitrate | 0–10 mg/L. |
| Organics | (Depends on the type, however, all known types are preferably minimized.) |
| Phosphates | 0–10 mg/L. |
| Silicates | 0–10 mg/L. |
| Sodium | 0–1 gm/L. |
| Strontium | 0–50 mg/L. |
| Zinc | 0–5 mg/L. |
| OPERATING PARAMETERS: | |
| Agitation Rate | 4–6 Linear ft/sec solution flow over the cathode surface. |
| Cathode (Mandrel) | Current Density, 20–100 ASF (amps per square foot). |
| Ramp Rise | 0 to operating amps in 0 to 5 min. ± 2 sec. |
| Plating Temperature at Equilibrium | 30–75° C. |
| Anode | High purity Armco ® iron or the like. |
| Anode to Cathode Ratio | 1:1 minimum. |
| Cathode | Titanium-palladium, 304 Stainless, Chromium-plated aluminum |
| Atmosphere | $N_2$ saturated with $H_2O$ |

In a preferred embodiment, an electrolyte solution of ferrous sulfate (33 oz./gal.), ferrous chloride (4.8 oz./gal.) and calcium chloride is prepared with no impurities. The pH of the solution is 3.25 and the surface tension is 55 d/cm. The agitation rate is 6 linear feet/sec.; the current density is 250 ASF; the ramp rise occurs in 1 minute; and the plating temperature at equilibrium is 95° C. The anode is an Armco ® high purity iron anode, and the anode to cathode ratio is 2:1.

The mandrel for an electroformed iron article is preferably solid and of large mass to prevent cooling of the mandrel while the deposited iron coating is cooled. In such an embodiment, the mandrel should have high heat capacity, preferably in the range from about 3 to about 4 times the specific heat of the iron deposit. This determines the relative amount of heat energy contained in the iron deposit compared to that in the mandrel.

Further, the mandrel in such an embodiment should exhibit low thermal conductivity to maximize the difference in temperature between the iron deposit and the mandrel during rapid cooling of the iron deposit to prevent any significant cooling and contraction of the mandrel.

Such high heat capacity and low thermal conductivity is unnecessary, however, when parting the electroform from the mandrel is not a problem, such as for plating, for preparing flat forms, spring forms and the like.

The cross-section of the mandrel may be of any suitable shape. The surface of the mandrel should be substantially parallel to the axis of the mandrel for electroforming.

During the operation of the mandrel in the electrolytic process, the mandrel may be connected to a rotatable drive shaft driven by a motor, and may be rotated in such a manner that the electrolyte bath is continuously agitated. Such movement continuously mixes the electrolyte bath to ensure a uniform mixture, and passes the electrolyte bath continuously over the mandrel.

Typical mandrel materials include titanium and titanium-palladium alloys, stainless steel, aluminum plated with nickel, nickel-copper alloys such as Inconel 600, nickel-iron alloys such as Invar (available from Inco), iron and the like. In a preferred embodiment, titanium-palladium alloys are used. A titanium-palladium alloy is preferred for electroforming because it is inert to the bath and surrounding atmosphere, which may be very corrosive, and is the most cost-effective. The process of electroplating iron on an iron electrode provides an iron article with improved magnetic properties.

Substantially any conductive material or material which has been made conductive may be used as the cathode for electroplating. Examples include copper, nickel, plated aluminum, zincated aluminum, anodized aluminum, conductive plastics, stainless steel, brass and bronze. The anode is preferably high-purity (Armco ®) iron, but steel and cast iron may also be used. Because no commercial iron is pure, anode bags should be used to retain the resulting slimes and sludges. Reagent grade iron wire (0.2286 mm) wrapped around a titanium bar stock works best. Few materials will resist the extremely corrosive conditions of the bath; glass fiber is usable, as are orlon and Dynel ® if the temperature is not too high. Napp Polyproplene is preferred for the anode bag.

The chemical composition and the physical characteristics of the iron deposit are determined by the materials which form the electrolyte bath and the physical environment in which the iron deposit is formed. Thus, both the bath chemistry and the operating parameters of the electrolytic process are controlled to produce an iron deposit with the desired characteristics. An electrolyte bath is a medium wherein complex interactions between such parameters as the temperature, electrolyte metal ion concentration, agitation, current density, density of the solution, cell geometry, conductivity, rate of flow and specific heat occur when forming the iron deposit. Many of these elements are also affected by the pH of the bath and the concentrations of such components as surface tension agents and impurities.

The control of many of the elements of the electrolyte bath, including the concentration of the impurities, and the operating parameters can largely be achieved by methods known in the art. For example, control of the electrolyte conductivity by means of adding a supporting electrolyte (for example calcium chloride) and preferred parameters for electrical current, time, and cell geometry are within the knowledge of those skilled in the art of electrolysis. The most important parameters are: $Fe^{+3}$ ion concentration, pH, temperature, amount of carbon containing constituents, and agitation rate. Of these, all but the pH and $Fe^{+3}$ ion may be controlled by conventional means. Temperature is controlled to +/−1° C. for best results with a thermostat. Carbon may be controlled by minimizing the amount of carbon in the system, e.g., by using only materials which are as free of carbon as possible, and by bath treatment before use which includes electrolysis at 3–5 amp/ft$^2$. This electrolysis treatment (often referred to as "dummying") will also reduce the concentrations of impurities such as Pb and Cu. Agitation may be provided by movement of the cathode via mechanical means and/or electrolyte movement via a pump (care being taken to ensure that air is not introduced via leaking pump seals). Current density is also important for achieving a desirable deposition speed. Current densities above 60 ASF, such as about 100 to about 400 ASF, are preferred.

The electrolyte pH is very important, as this parameter will drive the formation of $Fe^{+3}$ ions, deposit appearance, and the mechanical and magnetic properties. The pH may range as high as 4–5, but is preferably 1-3.5. A pH of 3.25+/−0.05 works best with a mixed iron chloride/iron sulfate bath. The stability of this pH may be maintained by providing an atmosphere of HCl around the electrolyte when adjusting the electrolyte pH with HCl. When the adjustments are made with $H_2SO_4$, no HCl atmosphere is needed. Iron (III) hydroxide precipitates at a pH of about 3.5, while iron (II) hydroxide does not precipitate until a pH of about 6 is reached. In the lower pH range (1-3), even a well reduced electrolyte contains some $Fe^{+3}$, and operation at a pH of 3.5 may result in dark, stressed deposits caused by inclusion of basic Fe (III) salts in the deposit; however, if the pH is too low, cathode efficiency suffers. In the high pH range of 4-5, Fe (III) hydroxide is always present as a sludge, but will not be included in the deposit unless the deposits are thick, provided one operates the electrolyte in a quiescent or semi-quiescent manner (i.e., no or limited mixing). The operation of these electrolytes at the high pH range may produce deposits that are less stressed and the bath may have better throwing power. Nearly stress free deposits can be obtained at the top end of the low pH range by maintaining a low $Fe^{+3}$ ion concentration in the electrolyte and providing agitation.

$Fe^{+3}$ ion concentration may be minimized by preparing the bath by exposing it to degreased steel wool (which reduces the $Fe^{+3}$ to $Fe^{+2}$), selecting materials for use which do not contain appreciable amounts of $Fe^{+3}$ in the first place, and preparing and operating the bath in an environment which is substantially free of oxygen ($O_2$) and other oxidizing agents. $O_2$ may be excluded by enveloping the electrolyte in a blanket of inert gas such as $N_2$ and removing $O_2$ from all equipment, chemicals, and materials which are in the proximity of the bath. For example, deionized water used for the bath may be enclosed in an air lock which has been purged with high purity $N_2$, and which is located adjacent to the electrolyte chamber. This water is preferably then brought to a boil while being aerated with $N_2$ for a minimum of 30 minutes before use to drive off further $O_2$. This preferably takes place before other bath components, especially volatile bath components, are combined with the water. Other bath components should similarly be purged of $O_2$, as should the electrodes, etc.

The electrolytic process of this invention may be conducted in any suitable electrolytic device which is protected from the corrosive materials in the bath and atmosphere. For example, a solid mandrel may be suspended vertically in an electroforming tank. The top edge of the mandrel may be masked off with a suitable, non-conductive material, such as wax, to prevent deposition.

In a preferred embodiment, the electrolyic tank includes an inner glass container 1 which holds the electrolyte bath 2. The glass container is preferably situated within a stainless steel container 3 in such a manner that a space is created between the glass container 1 and the stainless steel container 3. The space thus created may contain a heat transfer medium 4 useful for maintaining the temperature of the electrolyte bath at the desired temperature. The heat transfer medium may be water, sand with high thermal conductivity or the like. A vent 5 may be provided between the electroforming tank and the housing 6, which allows for the release of moisture and/or steam from the heat transfer medium. The stainless steel container is preferably of sufficient size to hold the entire contents of the glass container 1 and heat transfer medium in the event of breakage of the glass container 1.

The electrolytic tank is filled with the substantially oxygen-free electrolyte bath, and the temperature of the bath is maintained at the desired temperature. The electrolytic tank may contain an annular shaped anode basket which surrounds the mandrel if the mandrel or substrate is to be uniformly coated. This basket is preferably filled with iron chips or may be substituted with an iron wire or the like as discussed above. The anode basket is preferably disposed in axial alignment with the mandrel. The mandrel may be connected to a rotatable drive shaft driven by a motor, which is preferably isolated from the atmosphere of the electrolytic tank. The drive shaft and motor may be supported by suitable support members. Either the mandrel or the support for the electrolytic tank may be vertically and horizontally movable to allow the mandrel to be moved into and out of the electrolyte solution.

The bath and cathode are preferably heated to an appropriate temperature (in electroforming, a temperature sufficient to expand the cross-sectional area of the mandrel). The mandrel is introduced into the bath, and a ramp current is applied across the cathode and the anode to electrolytically deposit a coating of iron on the mandrel until the desired thickness is achieved. In the embodiment wherein iron is electroplated onto a substrate, the substrate itself may be electrodeposited on a mandrel, or may constitute the mandrel.

Electrolytic current can be supplied to the tank from a suitable DC source, which is preferably isolated from the atmosphere of the electrolytic tank. The positive end of the DC source can be connected to the anode basket and the negative end of the DC source connected to the drive shaft which supports and drives the mandrel. The electrolytic current passes from the DC source connected to the anode basket, to the plating solution, the mandrel, the drive shaft, and back to the DC source.

The electrolyte bath is contained in a housing 6 which is constructed of materials which are not attacked by the fumes and chemicals associated with the bath (for example, plexiglass, RTV® (silicon rubber formed by room-temperature vulcanization), polytetrafluoroethylene (e.g., Teflon®), glass, polyolefins, copper, thallium, gold, palladium, platinum, etc.). The housing 6 is constructed so that it can be flooded with a continuous stream of inert gas such as $N_2$ (hereinafter referred to in short as nitrogen or $N_2$) which is provided via gas cylinders (not shown) through transfer valves 10. The housing is preferably fitted with air lock doors 7 which allow the movement of materials such as the mandrel and bath components into the housing 8 and materials such as the electroformed part out of the housing, and between compartments 8, while excluding $O_2$. The arrangement of air lock doors 7 and compartments 8 enables the housing 6 to maintain the pressure of the compartment closest to the electroforming apparatus (P3) at a higher level than the pressures of the adjacent compartments (i.e., P2 and P1) and ambient pressure (P4) in such a manner that $P3>P2>P1>P4$.

The arrangement of air lock doors and compartments should ensure that each compartment maintains its relative pressure with respect to the adjacent chambers so that no oxygen will flow into the chambers.

Transfer valves 10 are preferably situated at the top of each compartment to permit the flow of nitrogen into the compartment and the release of pressure from the compartment. When the apparatus is operated at 100% humidity, the $N_2$ must be bubbled through water (and preferably also through HCl when an HCl saturated atmosphere is used) before passing into the compartments through transfer valves 10. Additionally, the airlock compartments 8 are preferably large enough to allow the purification and scrubbing (i.e., removal of $O_2$), for example with a flow of inert gas, of equipment, chemicals, and water. Condensate returns 11 may be used to collect the condensed steam and return it to the electrolyte bath via ducts (not shown). All equipment which does not have to be in the housing is preferably located outside of it and performs its function via seals in the housing perimeter. For example, the mandrel drive system motor, brush contacts, etc. may be located outside of the housing with only the drive shaft/current carrying component extending into the housing via a seal.

In operation, the mandrel is lowered into the electrolytic tank, and is preferably continuously rotated, while iron is deposited on its outer surface. When the iron has reached the desired thickness, the mandrel may be removed from the tank.

When an electroforming process is complete and the iron is to be removed from the mandrel, the mandrel is removed from the electrolytic tank and the housing through the airlocks and immersed in a cold water bath. The temperature of the cold water bath is preferably between about 80° F. and about 33° F. When the mandrel is immersed in the cold water bath, the iron is cooled prior to any significant cooling and contracting of the mandrel. The iron deposit is thus permanently deformed, so that after the mandrel is cooled and contracted, the deposited electroformed iron (or electroplated iron and substrate) may be easily removed from the mandrel. The metal deposit so formed does not adhere to the mandrel because the mandrel is formed from a passive material. Consequently, as the mandrel shrinks after permanent deformation of the deposited metal, the latter may be readily slipped off the mandrel.

Electroplated iron of the invention has been found to be particularly useful with nonmagnetic materials which can be coated to make them magnetic, such as aluminum, plastic, and stainless steel. The deposited materials have many uses, such as shielding devices, magnetically driven tuning fork mirror mounts which are used in laser scanners and/or printing devices and as magnetic hold spots for robotic manipulation. The electrodeposited iron does not show signs of oxidation even after months of exposure to air.

The invention will further be illustrated in the following non-limitative examples, it being understood that these examples are intended to be illustrative only. Except as otherwise specified, the electrodeposition of these examples is carried out in the apparatus of FIG. 1 with oxygen removed from the apparatus and materials as described above.

EXAMPLE 1

| | |
|---|---|
| MAJOR ELECTROLYTE CONSTITUENTS: | |
| Ferrous chloride - as $FeCl_2.4H_2O$ | 50 oz/gal. |
| Calcium chloride - as $CaCl_2.2H_2O$ | 22 oz/gal. |
| pH - at 25° C. (Adjusted with HCl) | 1.6 |
| Surface Tension - at 60° C., using sodium lauryl sulfate (about 0.00005 g/L) | 65 d/cm. |
| IMPURITIES: | |
| Aluminum | 0 mg/L. |

-continued

| | |
|---|---|
| Ammonia | 0 mg/L. |
| Arsenic | 0 mg/L. |
| Barium | 0 mg/L. |
| Copper | 0 mg/L. |
| Carbon | 0 mg/L. |
| Hexavalent chromium | 0 mg/L. |
| Iron ($Fe^{+3}$) | 0 mg/L. |
| Lead | 0 mg/L. |
| Nitrate | 0 mg/L. |
| Organics | 0 mg/L. |
| Phosphates | 0 mg/L. |
| Silicates | 0 mg/L. |
| Sodium | 0 mg/L. |
| Strontium | 0 mg/L. |
| Zinc | 0 mg/L. |
| OPERATING PARAMETERS: | |
| Agitation Rate - Linear ft/sec solution flow over the cathode surface. | 6 Linear ft/sec. |
| Cathode (Mandrel) - Current Density, ASF (amps per square foot). | 75 ASF. |
| Ramp Rise - 0 to operating amps | 1 min. ± 2 sec. |
| Plating Temperature at Equilibrium | 90° C. |
| Anode | Armco ®. |
| Anode to Cathode Ratio | 2:1. |
| Cathode | Titanium-palladium |
| Atmosphere | $N_2$ Saturated with $H_2O$ and HCl |

Deposit characteristics (for example, hardness of 275+/−5 Vickers and elongation in a 2 inch pull of 17+/−2%) are found to be stable when operating at the preferred parameters even after 10 days at 1500 amp hr per gal per day. Fe(III) concentrations are kept below 20 mg/L by excluding $O_2$ and minimizing the introduction of Fe(III) via electrolyte make up. When the electrolyte is operated in the open, every deposit has very different characteristics and pH is difficult to maintain.

Deposits made on 304 stainless steel have excellent adhesion. A 304 stainless steel bar which weights two lbs. is easily handled with a magnet after being plated with a band of iron 3 mm wide around its circumference and only 0.00254 mm thick. Ten lbs of additional force are required to separate the magnet from the suspended bar. Excellent electroforms are made using the titanium-palladium mandrels. The electroforms do not rust after sitting for 60 days in an office environment.

EXAMPLE 2

| | |
|---|---|
| MAJOR ELECTROLYTE CONSTITUENTS: | |
| Ferrous sulfate - as $FeSO_4.7H_2O$ | 32 oz/gal. |
| pH - at 25° C. (Adjusted with $H_2SO_4$) | 3.0 |
| Surface Tension - at 60° C., using sodium lauryl sulfate (about 0.00005 g/L) | 50 d/cm. |
| IMPURITIES: | |
| Aluminum | 0 mg/L. |
| Ammonia | 0 mg/L. |
| Arsenic | 0 mg/L. |
| Barium | 0 mg/L. |
| Copper | 0 mg/L. |
| Carbon | 0 mg/L. |
| Hexavalent chromium | 0 mg/L. |
| Iron ($Fe^{+3}$) | 0 mg/L. |
| Lead | 0 mg/L. |
| Nitrate | 0 mg/L. |
| Organics | 0 mg/L. |
| Phosphates | 0 mg/L. |
| Silicates | 0 mg/L. |
| Sodium | 0 mg/L. |
| Strontium | 0 mg/L. |
| Zinc | 0 mg/L. |
| OPERATING PARAMETERS: | |
| Agitation Rate - Linear ft/sec solution | 6 Linear ft/sec. |

-continued

| | |
|---|---|
| flow over the cathode surface. | |
| Cathode (Mandrel) - Current Density, ASF (amps per square foot). | 50 ASF. |
| Ramp Rise | 1 min. ± 2 sec. |
| Plating Temperature at Equilibrium | 65° C. |
| Anode | Armco ®. |
| Anode to Cathode Ratio | 2:1. |
| Cathode | Titanium-palladium |
| Atmosphere | $N_2$ Saturated with $H_2O$ |

Deposit characteristics (for example, hardness of 315+/−7 Vickers and elongation in a 2 inch pull of 10+/−2%) are found to be stable when operating at the preferred parameters even after 10 days at 1000 amp hr per gal per day. The stability is not as good as seen with the chloride bath in Example 1, however. Fe(III) concentrations are kept below 50 mg/L by excluding $O_2$ and minimizing the introduction of Fe(III) via electrolyte make up. When the electrolyte is operated in the open, every deposit has very different characteristics and pH is more difficult to maintain but not as difficult as with the chloride bath in Example 1. At higher pH (about 3.4) the deposit becomes rough and more brittle. Fe(III) hydroxide is observed to be precipitating in the bath.

Deposits made on 304 stainless steel have excellent adhesion only after activation of the stainless steel. A 304 stainless steel bar which weighs two lbs. is just barely handled with a magnet after being plated with a band of iron 3 mm wide around its circumference and only 0.00254 mm thick. One tenth of a lb. of force is required to separate the magnet from the suspended bar. Excellent electroforms are made using titanium-palladium mandrels, 304 stainless mandrels, and chromium plated aluminum mandrels. The electroforms show some rust after sitting for 30 days in an office environment.

EXAMPLE 3

| | |
|---|---|
| MAJOR ELECTROLYTE CONSTITUENTS: | |
| Ferrous sulfate - as $FeSO_4.7H_2O$ | 33 oz/gal. |
| Chloride - as $FeCl_2.4H_2O$ | 4.8 oz/gal. |
| Calcium chloride - as $CaCl_2.2H_2O$ | 3 oz/gal. |
| pH - at 25° C. (Adjusted with $H_2SO_4$) | 3.25 |
| Surface Tension - at 60° C., using sodium lauryl sulfate (about 0.00005 g/L) | 55 d/cm. |
| IMPURITIES: | |
| Aluminum | 0 mg/L. |
| Ammonia | 0 mg/L. |
| Arsenic | 0 mg/L. |
| Barium | 0 mg/L. |
| Copper | 0 mg/L. |
| Carbon | 0 mg/L. |
| Hexavalent chromium | 0 mg/L. |
| Iron ($Fe^{+3}$) | 0 mg/L. |
| Lead | 0 mg/L. |
| Nitrate | 0 mg/L. |
| Organics | 0 mg/L. |
| Phosphates | 0 mg/L. |
| Silicates | 0 mg/L. |
| Sodium | 0 mg/L. |
| Strontium | 0 mg/L. |
| Zinc | 0 mg/L. |
| OPERATING PARAMETERS: | |
| Agitation Rate - Linear ft/sec solution flow over the cathode surface. | 6 Linear ft/sec. |
| Cathode (Mandrel) - Current Density, ASF (amps per square foot). | 250 ASF. |
| Ramp Rise | 1 min. ± 2 sec. |
| Plating Temperature at Equilibrium | 95° C. |
| Anode | Armco ®. |

-continued

| | |
|---|---|
| Anode to Cathode Ratio | 2:1. |
| Cathode | Titanium-palladium |
| Atmosphere | $N_2$ Saturated with $H_2O$ |

Deposit characteristics (for example, hardness of 300+/−4 Vickers and elongation in a 2 inch pull of 19+/−2%) are found to be stable when operating at the preferred parameters even after 10 days at 5000 amp hr per gal per day. The stability is better than seen with the chloride bath in Example 1. Fe(III) concentrations are kept below 20 mg/L by excluding $O_2$ and minimizing the introduction of Fe(III) via electrolyte make up. When the electrolyte is operated in the open every deposit has very different characteristics and pH is more difficult to maintain but not as difficult as with the chloride bath in Example 1. At higher pH (about 3.4) the deposit becomes rough and more brittle. Fe(III) hydroxide is observed to be precipitating in the bath.

Deposits made on 304 stainless steel have excellent adhesion only after activation of the stainless steel. A 304 stainless steel bar which weights two lbs. is easily handled with a magnet after being plated with a band of iron 3 mm wide around its circumference and only 0.00254 mm thick. Fifteen lbs of force are required to separate the magnet from the suspended bar. Excellent electroforms are made using the titanium-palladium mandrels, 304 stainless steel mandrels, and chromium plated aluminum mandrels. The electroforms show no rust after sitting for 60 days in an office environment.

Although the invention has been described with reference to specific preferred embodiments, it is not intended to be limited thereto. Those skilled in the art will recognize that variations and modifications can be made therein which are within the spirit of the invention.

What is claimed is:

1. A process for electrolytically depositing iron, comprising:

removing oxygen from electrolytic bath components until they are substantially oxygen-free;

introducing said substantially oxygen-free bath components into a substantially oxygen-free electrolytic tank to form an electrolytic bath containing salts of iron under a substantially oxygen-free atmosphere in a housing containing said electrolytic tank;

introducing a substantially oxygen-free deposition electrode into said electrolytic bath;

electrodepositing iron onto said deposition electrode in said electrolytic bath; and removing said deposition electrode with the electrodeposited iron from said electrolytic tank.

2. The process of claim 1, wherein said oxygen is removed from said electrolytic bath components before they are combined to form said electrolytic bath.

3. The process of claim 1, wherein one said component of said electrolytic bath is water, and an inert gas is bubbled through said water to remove oxygen before any volatile other said component is combined with said water.

4. The process of claim 1, wherein said electrolytic bath is substantially free of oxidizing agents.

5. The process of claim 1, wherein an inert gas is fed into said housing above a surface level of said bath to form and maintain said substantially oxygen-free atmosphere.

6. The process of claim 4, wherein a pH of said electrolytic bath is maintained with a halo acid, and said inert gas is saturated with a corresponding hydrogen halide before said inert gas is fed into said housing.

7. The process of claim 6, wherein said salts of iron are halide salts in which the halide group is the same as the halide group of said hydrogen halide.

8. The process of claim 1, wherein said salts or iron are halide salts and said atmosphere is saturated with a corresponding hydrogen halide.

9. The process of claim 8, wherein said hydrogen halide is hydrogen chloride and said salts are iron chloride salts.

10. The process of claim 1, wherein said salts of iron do not contain $Fe^{+3}$.

11. The process of claim 1, wherein said salts are selected from the group consisting of ferrous chloride, ferrous ammonium sulfate and ferrous sulfate.

12. The process of claim 1, wherein a concentration of $Fe^{+3}$ ion in said electrolytic bath is minimized by exposing said electrolytic bath to degreased steel wool.

13. The process of claim 1, wherein said electrolytic bath contains less than 20 ppm carbon.

14. The process of claim 1, wherein substantially pure iron is electrodeposited.

15. The process of claim 1, wherein said housing comprises a series of airlocks, said deposition electrode is introduced into said electrolytic bath through said series of airlocks and the deposition electrode with the electrodeposited iron is removed from the housing through said series of airlocks to maintain said electrolytic bath and atmosphere substantially oxygen-free through a series of electrodepositions.

16. The process of claim 1, wherein said electrolytic bath has a pH of about 3.2–5.

17. The process of claim 1, wherein said electrolytic bath has a pH of 4–5.

18. The process of claim 1, wherein the iron is electrodeposited at a current density greater than about 60 amps per square foot.

19. The process of claim 18, wherein said current density is from about 100 to about 400 amps per square foot.

20. The process of claim 1, wherein said deposition electrode is comprised of a titanium-palladium alloy.

21. The process of claim 1, wherein said deposition electrode comprises at least one material selected from the group consisting of iron and steel.

22. The process of claim 1, wherein said iron is permanently electroplated on said deposition electrode.

23. The process of claim 22, wherein said deposition electrode comprises a material selected from the group consisting of copper, nickel, plated aluminum, zincated aluminum, anodized aluminum, conductive plastics, stainless steel, brass and bronze.

24. The process of claim 1, further comprising removing said iron from said deposition electrode as an electroformed article.

* * * * *